US008090299B2

(12) United States Patent
Mori et al.

(10) Patent No.: US 8,090,299 B2
(45) Date of Patent: Jan. 3, 2012

(54) DEVELOPER SUPPLY DEVICE, PROCESS CARTRIDGE, AND IMAGE FORMING APPARATUS

(75) Inventors: Keitaro Mori, Kanagawa (JP); Ryosaku Igarashi, Kanagawa (JP); Yasuaki Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 514 days.

(21) Appl. No.: 12/335,640

(22) Filed: Dec. 16, 2008

(65) Prior Publication Data

US 2009/0262164 A1 Oct. 22, 2009

(30) Foreign Application Priority Data

Apr. 17, 2008 (JP) ..... 2008-107941

(51) Int. Cl.
*G03G 15/10* (2006.01)

(52) U.S. Cl. ..... 399/237; 399/57

(58) Field of Classification Search ..... 399/53, 399/57, 119, 222, 237, 254, 256, 263
See application file for complete search history.

(56) References Cited

U.S. PATENT DOCUMENTS

| | | | | |
|---|---|---|---|---|
| 3,321,795 | A * | 5/1967 | Richardson | 401/197 |
| 3,743,408 | A * | 7/1973 | Ohno | 399/237 |
| 3,876,282 | A * | 4/1975 | Schon et al. | 399/238 |
| 3,894,512 | A * | 7/1975 | Ohno | 399/238 |
| 4,058,637 | A * | 11/1977 | Ohno | 430/118.3 |
| 4,990,962 | A * | 2/1991 | Kishi | 399/233 |
| 6,148,166 | A * | 11/2000 | Watanabe | 399/239 |
| 7,867,684 | B2 * | 1/2011 | Watanabe et al. | 430/115 |
| 2009/0017232 | A1 * | 1/2009 | Watanabe et al. | 428/29 |
| 2009/0236558 | A1 * | 9/2009 | Kobayashi et al. | 252/62.54 |
| 2009/0239174 | A1 * | 9/2009 | Inaba et al. | 430/112 |
| 2009/0245874 | A1 * | 10/2009 | Mori et al. | 399/239 |
| 2009/0274973 | A1 * | 11/2009 | Watanabe et al. | 430/112 |
| 2010/0248111 | A1 * | 9/2010 | Kobayashi et al. | 430/105 |
| 2010/0248127 | A1 * | 9/2010 | Inaba et al. | 430/112 |

FOREIGN PATENT DOCUMENTS

| | | |
|---|---|---|
| JP | 5-87834 | 9/1991 |
| JP | 5-188827 | 7/1993 |
| JP | 6-4008 | 1/1994 |
| JP | 9-156150 | 6/1997 |
| JP | 11-119509 | 4/1999 |

* cited by examiner

*Primary Examiner* — David Gray
*Assistant Examiner* — G. M. Hyder
(74) *Attorney, Agent, or Firm* — Fildes & Outland, P.C.

(57) ABSTRACT

A developer supply device, includes: a developer holder; and a developer reservoir which is disposed inside of the developer holder, holds a liquid developer, and has at least one supply section that supplies the liquid developer from the developer reservoir to the developer holder, the liquid developer including a toner and an aqueous medium, and the developer supply device supplying the liquid developer that has been supplied to the developer holder to a medium which is a supply target for the liquid developer.

4 Claims, 4 Drawing Sheets

DEVELOPER SUPPLY DEVICE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2008-107941 filed on Apr. 17, 2008.

BACKGROUND

1. Technical Field

The present invention relates to a developer supply device, a process cartridge, and an image forming apparatus.

2. Related Art

A magnetic copying machine that prints a desired number of copies by forming a latent image only once is known. In the magnetic copying machine, printing is performed as follows: a magnetic latent image is magnetically formed and held on a magnetic recording medium (magnetic latent image holder); magnetic toner is supplied to the magnetic recording medium so as to visualize the magnetic latent image as a toner image in a development area; a recording medium such as paper is pressed onto the magnetic recording medium so that the visualized toner image is transferred to the recording medium in a transfer area; and, subsequently, the recording medium is conveyed to a fixing area, and the toner image is fixed on the recording medium.

SUMMARY

According to an aspect of the invention, there is provided a developer supply device, including:

a developer holder; and a developer reservoir which is disposed inside of the developer holder, holds a liquid developer, and has at least one supply section that supplies the liquid developer from the developer reservoir to the developer holder, the liquid developer comprising a toner and an aqueous medium, and the developer supply device supplying the liquid developer that has been supplied to the developer holder to a medium which is a supply target for the liquid developer.

BRIEF DESCRIPTION OF THE DRAWINGS

Exemplary embodiments of the present invention will be described in detail based on the following drawings, wherein.

DETAILED DESCRIPTION

Hereinafter, exemplary embodiments of the present invention will be described in detail.

According to an exemplary embodiment of the invention, a developer supply device is provided. The developer supply device includes: a developer holder; and a developer reservoir which is disposed inside of the developer holder, holds a liquid developer including a toner and an aqueous medium, and includes at least one supply section that supplies the liquid developer from the developer reservoir to the developer holder. The developer supply device supplies the liquid developer that has been supplied to the developer holder to a medium to the liquid developer is supplied (or a medium which is a supply target for the liquid developer).

According to another exemplary embodiment of the invention, a developer supply device has a surface formed by a developer holder and is configured to hold therein a liquid developer that includes a toner and an aqueous medium, allow the liquid developer to exude from the inside thereof so that the liquid developer is supplied to the developer holder, and supply the liquid developer which has been supplied to the developer holder to a medium which is a supply target for the developer.

In the exemplary embodiments of the invention, a liquid developer in which a toner is dispersed in an aqueous medium may be used as a developer. Hereinafter, the term "aqueous medium" indicates a solvent that includes water in an amount of 50% by weight or more with respect to the total weight of the solvent. In addition, the term "water" indicates purified water including distilled water, ion-exchange water, ultra pure water, and the like.

The developer supply device may be used, for example, in an image forming process that includes forming a latent image on a latent image holder, which serves as a medium to which developer is supplied, and then forming a toner image using the liquid developer. Specific examples of the image forming process that involves forming a latent image on a latent image holder and then forming an image, include a magnetic development process and a process in which a toner or ink dispersed in an aqueous medium is used as a developer in printing.

In the following, among the development processes that meet the requirements for the developer supply device according to the above exemplary embodiment and the developer supply device according to the above other exemplary embodiment, two embodiments of the image forming apparatus using a magnetic development process will be described briefly. Further, a process cartridge will also be described in the following exemplary embodiment of an image forming apparatus. Moreover, constituent materials and the like of the liquid developer to be used will be described thereafter.

Image Forming Apparatus According to First Exemplary Embodiment

Figure 1:
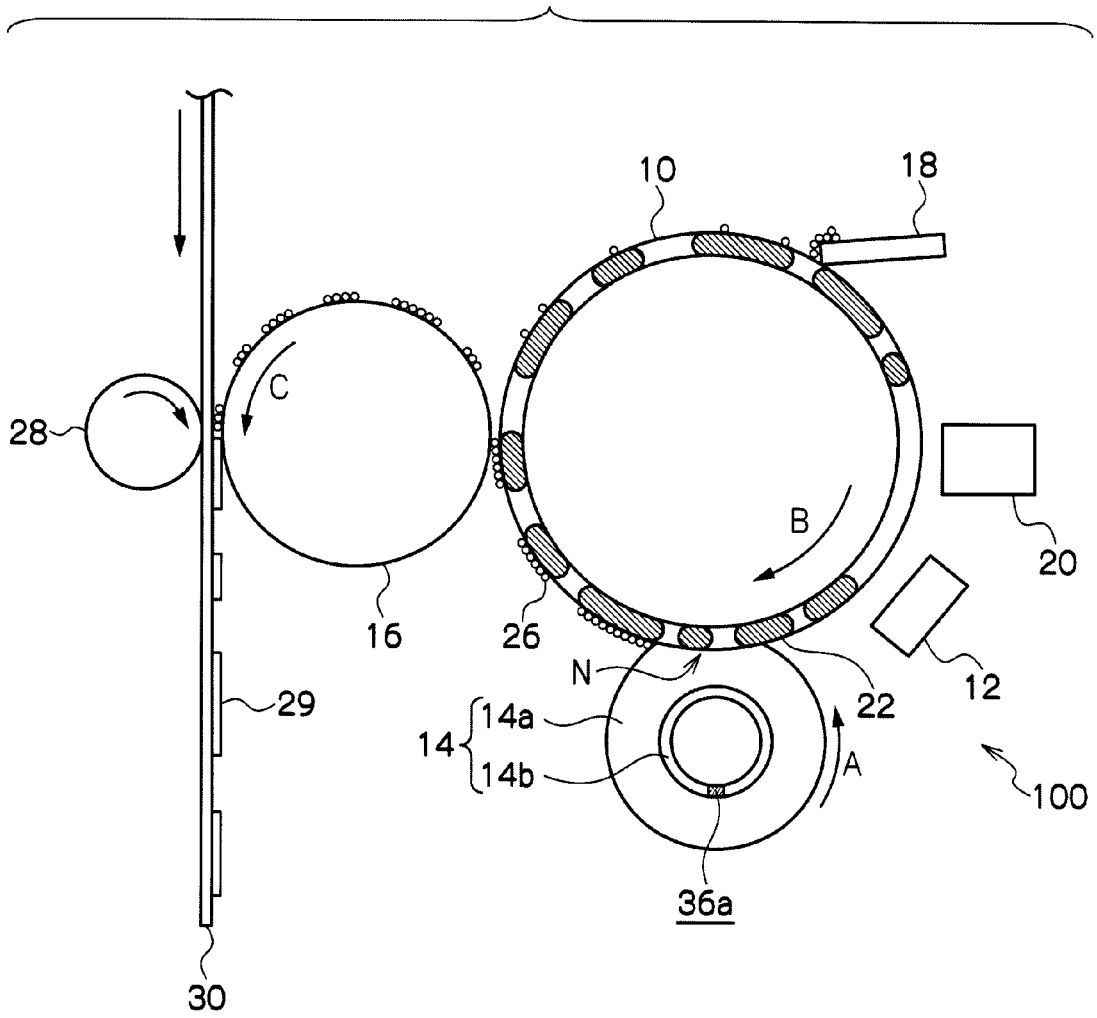
FIG. 1 is a schematic diagram showing an example of an image forming apparatus according to a first exemplary embodiment of the invention.

FIG. 1 is a schematic diagram showing an example of an image forming apparatus according to a first embodiment of the present invention. The image forming apparatus 100 includes: a magnetic drum (magnetic latent image holder) 10 that serves as a medium to which developer is supplied; a magnetic head (magnetic latent image forming device) 12; a developer supply device 14 including a developer reservoir 14*b* and a developer holder 14*a*; an intermediate transfer member (transfer unit) 16; a cleaner 18; a demagnetization device 20; and a transfer-fixing roller (fixation unit) 28. The magnetic drum 10 has a cylindrical shape. The magnetic head 12, the developer supply device 14, the intermediate transfer member 16, the cleaner 18, and the demagnetization device 20 are disposed around the periphery of the magnetic drum 10 in this order.

Hereinafter, the operation of the image forming apparatus will be described briefly.

First, the magnetic head 12 is connected to, for example, an information device (not shown) and receives binarized image data sent from the information device.

The magnetic head 12 emits magnetic force while it scans the side surface of the magnetic drum 10, whereby a magnetic latent image 22 is formed on the magnetic drum 10. Note that, in FIG. 1, the magnetic latent image 22 is shown by a hatched part in the magnetic drum 10.

Figure 2A:
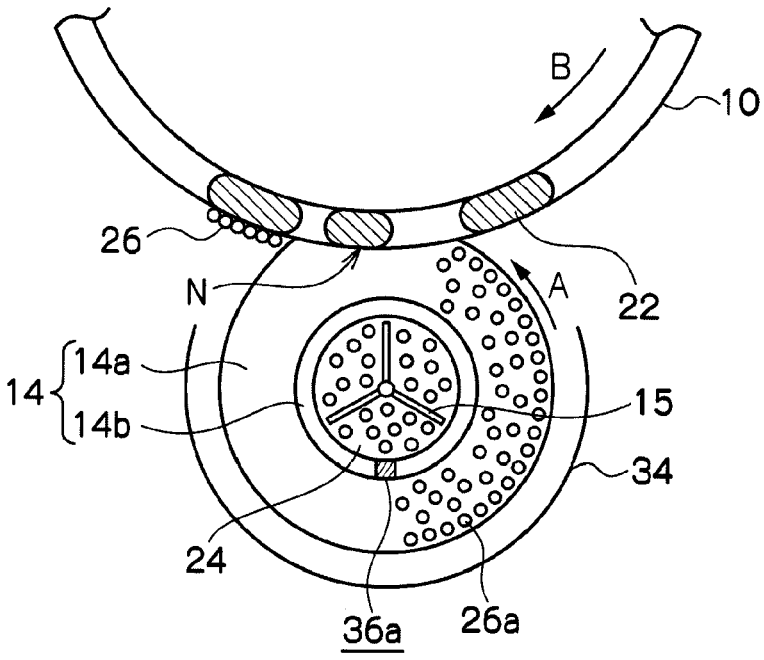
FIG. 2A is an enlarged schematic diagram showing a development area of the example of the image forming apparatus according to the first exemplary embodiment of the invention.
Figure 2B:
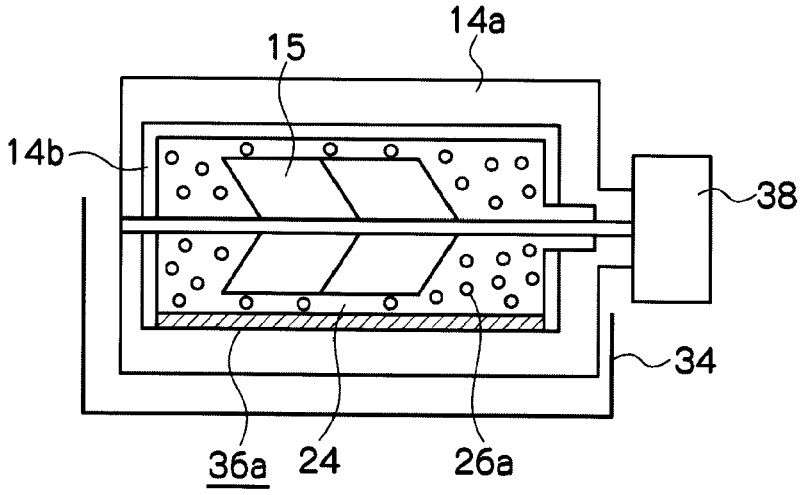
FIG. 2B is a lateral cross-sectional view of a developer supply device shown in FIG. 2A.

FIG. 2A shows an enlarged schematic diagram of the development area shown in FIG. 1, and FIG. 2B shows a lateral cross-sectional view of FIG. 2A.

As shown in FIG. 2A, the developer supply device 14 includes a developer holder 14*a* at the surface thereof and a developer reservoir 14*b* inside of the developer holder 14*a*. The developer holder 14*a* disposed at the surface of the developer supply device is rotated in the direction of an arrow A shown in FIG. 2A by a motor 38 serving as a driving device shown in FIG. 2B. Further, the developer reservoir 14*b* placed inside of the developer supply device is fixed so as not to rotate. The developer reservoir 14*b* has, at a wall thereof, at least one slit 36*a* which serves as a supply section and which is formed in the direction along which gravitational acceleration acts (in a downward direction in FIG. 2A and FIG. 2B). The slit 36*a* is shown by a hatched part in the wall of the developer reservoir 14*b* in FIG. 2A and FIG. 2B. The slit 36*a*, as shown in FIG. 2B, is formed along the entire length of the developer reservoir 14*b* in the axial direction thereof. The developer reservoir 14*b* is fixed so as not to rotate as described above. A liquid developer 24 held in the developer reservoir 14*b* exudes through the slit 36*a* owing to gravitational force and is supplied to the developer holder 14*a* that rotates in the direction of the arrow A. The developer holder 14*a* is formed of a foam as a member which absorbs a liquid (which may hereinafter be referred to as a liquid absorbent member). The liquid developer 24 that exudes from the slit 36*a* is retained in the foam. The developer reservoir 14*b* may be provided inside with agitation blades 15 that serve as an agitation member which agitates the liquid developer 24.

The foam that forms the developer holder 14*a* is positioned in such a manner that the foam is compressed when it contacts the magnetic drum 10. Hereinafter, the area of the foam in which the foam is compressed by and contacts with the magnetic drum may be referred to as a "compression area". The magnetic drum 10 and the developer holder 14*a* are driven to rotate in an opposite direction to each other as shown by arrow A and arrow B, respectively, in FIG. 1. The developer supply device 14 is disposed in the direction along which gravitational acceleration acts with respect to the magnetic drum 10 (i.e. in a downward direction in FIG. 1). The liquid developer 24 retained in the foam of the developer holder 14*a* is conveyed to a compression area N in which the foam is compressed by the magnetic drum 10, whereby the liquid developer 24 exudes from the foam and is supplied onto the magnetic latent image 22. As a result, the magnetic latent image 22 is visualized as a toner image 26. At a position at which the foam is freed from compression, the solvent contained in the liquid developer 24 and the toner attached onto non-imaging portions are recovered by the capillary action of the foam, whereby the amount of the solvent residue on the magnetic drum 10 may be reduced.

In the first exemplary embodiment, the magnetic drum 10 that is used has a higher water repellency than that of the foam that forms the developer holder 14*a*, and an aqueous medium is used as the solvent for the liquid developer 24. Accordingly, the solvent is hardly transferred to the magnetic drum 10 even when the liquid developer 24 contacts with the magnetic drum 10 upon development, because water has a high surface tension owing to hydrogen bonding. The solvent that is not transferred and remains on the developer holder 14*a* is recovered by the capillary action of the foam, whereby the amount of the solvent residue on the magnetic drum 10 may be reduced.

Further, a shield member 34 which blocks off scattering liquid drops that are splashed from the foam by the rotation of the developer holder 14*a* is provided on the periphery of the developer holder 14*a*.

The liquid developer 24 may include an aqueous medium and toner particles 26*a*. The toner particles 26*a* are a magnetic toner including a magnetic body. The details of the aqueous medium and toner particles 26*a* will be described later.

The toner image 26 thus developed may conveyed by the magnetic drum 10 rotating in the direction of the arrow B shown in FIG. 1 and may then be transferred to a sheet of paper (recording medium) 30. However, in the first exemplary embodiment, since fixing is performed simultaneously with transfer of the toner image onto the sheet 30, the toner image is first temporarily transferred onto the intermediate transfer member 16.

Transfer onto the intermediate transfer member 16 may be performed by shearing transfer (non-electric transfer) because the toner particles are hardly charged. Specifically, the magnetic drum 10 which rotates in the direction of the arrow B and the intermediate transfer member 16 which rotates in the direction of the arrow C are allowed to contact each other at a predetermined contact area (that is, a contact surface having a certain length in the rotation direction), and the toner image 26 is transferred onto the intermediate transfer member 16 by adsorption force, which is stronger than the magnetic force that the magnetic drum 10 exerts on the toner image 26 on the magnetic drum 10. At this time, a disparity may be set in the respective circumferential velocities of the magnetic drum 10 and the intermediate transfer member 16.

After that, the toner image 26 is conveyed by the intermediate transfer member 16 into the direction of the arrow C, transferred onto the sheet 30, and fixed thereon at the contact area with the transfer-fixing roller 28.

The sheet 30 is sandwiched between the transfer-fixing roller 28 and the intermediate transfer member 16, so that the toner image 26 on the intermediate transfer member 16 is adhered onto the sheet 30, whereby the toner image 26 is transferred onto the sheet 30 and, at the same time, fixed on the sheet 30. Depending on the properties of the toner, the toner image 26 may be fixed only by pressing or by pressing and heating using a transfer-fixing roller 28 equipped with a heating element.

Meanwhile, after the toner image 26 has been transferred onto the intermediate transfer member 16, the toner that remains on the magnetic drum 10 is conveyed to the contact area with the cleaner 18 and recovered by the cleaner 18. After the cleaning, the magnetic drum 10 keeps rotating to a demagnetization area while the magnetic latent image 22 is retained on the drum.

The demagnetization device 20 erases the magnetic latent image 22 that has been formed on the magnetic drum 10. The magnetic condition of the magnetic layer of the magnetic drum 10 is restored by the cleaner 18 and demagnetization device 20, to the condition before the image was formed. By repeating the foregoing operations, images sent from the information device may be visualized continuously in a short time. Further, the magnetic head 12, the developer supply device 14, the intermediate transfer member 16, the transfer-fixing roller 28, the cleaner 18, and the demagnetization device 20 may operate in synchronization with the rotation speed of the magnetic drum 10.

Next, each of the constituents of the image forming apparatus according to the first exemplary embodiment will be described.

Magnetic Latent Image Holder

The magnetic drum (magnetic latent image holder) 10 may include: a drum made of a metal such as aluminum; an underlying layer which is made of Ni, Ni—P, or the like and formed in a thickness of from about 1 μm to about 30 μm on the drum; a magnetic recording layer which is made of Co—Ni, Co—P, Co—Ni—P, Co—Zn—P, Co—Ni—Zn—P, or the like and formed in a thickness of from about 0.1 μm to about 10 μm on the underlying layer; and a protection layer which is made of Ni, Ni—P, or the like and formed in a thickness of from about 0.1 μm to about 5 μm. Each of the layers may be formed by plating. Specifically, the underlying layer may be formed by dense and even plating without defects such as pinholes. Besides plating, each of the layers may be formed by sputtering, vacuum deposition or the like. Further, the underlying layer and protection layer may each be non-magnetic. The surface accuracy of each layer may be maintained at a certain degree by tape polishing or the like.

The thickness of the magnetic recording layer may be from 0.1 μm to 10 μm. The magnetic properties of the magnetic recording layer may be as follows: coercive force is from 16,000 A/m to 80,000 A/m (or from 200 oersted to 1,000 oersted (Oe)) and residual magnetic flux density is from 100 mT to 200 mT (or from 1,000 gauss to 2,000 gauss (G)).

An exemplary configuration of the magnetic drum 10 of longitudinal magnetic recording is described above. In the case of vertical magnetic recording, a magnetic drum may have, but not limited to, a configuration in which a recording layer made of Co—Ni—P or the like is formed on a non-magnetic layer or a configuration in which a soft magnetic layer having a high magnetic permeability may be formed under the recording layer. The magnetic latent image holder not limited to a drum as used in the first exemplary embodiment, and may be a belt or the like.

In the first exemplary embodiment, the surface water repellency of the magnetic drum 10 is set to be higher than that of a developer holder (or a foam) which will be described below. The term "water repellency" as used herein indicates a property of repelling water, and is specifically defined in terms of a contact angle between the surface and pure water.

The contact angle at which water meets the surface of the magnetic drum 10 is preferably 70° or more and is more preferably 100° or more.

The contact angle on the surface of the magnetic drum 10 may be evaluated as follows. In an environment of 25° C. and 50% RH, 3.1 μl of pure water are dripped onto the surface of a magnetic drum and, after 15 seconds, the contact angle is measured with a contact angle meter (CA-X (trade name), manufactured by Kyowa Interface Science Co., Ltd.). The measurement is performed at four different points at the ends and center of the magnetic drum, respectively, along the circumferential direction of the drum axis. The average of the measured values is regarded as a contact angle. Further, the contact angle on a foam (or a liquid absorbent member) as described below may also be measured by the method described above.

In order to allow the surface of the magnetic drum 10 to have a preferable contact angle, a surface coating may be applied on the surface of the magnetic drum that is configured as described above.

Examples of the surface coating include a fluorine-containing lubricating plating and a coating including a fluorine atom-containing or silicon atom-containing polymer. The fluorine-containing lubricating plating is a functional plating that is prepared by co-depositing and compositing a fluororesin (e.g., polytetrafluoroethylene: PTFE) with an electroless nickel plating. In the resultant coating, the PTFE particles are evenly deposited, whereby the coating has both properties of electroless nickel plating and PTEF resin.

Regarding the coating including a fluorine atom-containing or silicon atom-containing polymer, for example, a polymer having a fluorine-containing ring structure, a copolymer of a fluoroolefin and a vinyl ether, a photo-polymerizable fluororesin composition, or the like may be applied on the surface of the protection layer, or a fluorine atom-containing polymer may be applied on the entire surface of the protection layer by sputtering.

Among these, the fluorine-containing lubricating plating is preferable. The fluorine-containing lubricating plating or the fluororesin coating may be applied on the protection layer after the protection layer is formed, or a layer that is formed from the fluorine-containing lubricating plating or the fluororesin coating may be used as a protection layer.

The thickness of the surface layer formed by the surface coating may be from 0.1 μm to 5 μm and preferably from 0.3 μm to 3 μm.

Magnetic Latent Image Forming Device

A magnetic latent image forming apparatus (magnetic latent image forming device) includes a magnetic head 12 and a driving circuit thereof. The magnetic head 12 may roughly be classified into a full-line magnetic head and a multi-channel magnetic head. In the case where the magnetic head 12 is a full-line magnetic head, it is not necessary to move the magnetic head 12 for scanning. In contrast, in the case where the magnetic head 12 is a multi-channel magnetic head, it is necessary to move the magnetic head 12 across the magnetic drum 10 for scanning. Examples of a method for scanning include a serial scanning and a helical scanning. In the helical scanning, the rotation speed of the magnetic drum 12 is changed especially only in the latent image forming step, whereby recording speed may be increased in the latent image forming step.

On the other hand, in the case of the full-line magnetic head, for example, a head having about 500 channels is necessary to cover a range of an A4 size paper (ISO 216) in the width direction thereof when resolution is set to be 600 dpi (dpi: number of dots per 1 inch). When plural heads are arrayed into a full-line configuration, it is not necessary to move the resultant head for scanning, thereby enabling an extremely high speed recording. For making the full-line configuration, head cores of the heads are required to be superimposed to each other. As the resolution becomes higher, the track pitch becomes narrower. Therefore, coils which are inserted into the head cores are required to be as thin as possible, and for example, planer sheet coils may be used.

An electric current is sent through the coil of each of the channels of the magnetic head 12 so as to generate a leakage flux at the tip of each magnetic pole, and the magnetic recording medium is magnetized by the leakage flux, thereby forming a magnetic latent image. The output from the magnetic head 12 may be a magnitude two to three times of the coercive force of the magnetic recording layer on the magnetic drum 10. The magnetic latent image thus formed may not be erased as long as it is erased with the demagnetization device 20, thereby providing a multi-copy function by repeating the steps of development, transfer, fixing, and cleaning.

Developer Supply Device

As shown in FIG. 2A, the developer supply device 14 includes a developer reservoir 14*b* inside thereof and a developer holder 14*a* on the surface thereof. In this device, the liquid developer 24 is supplied from the developer reservoir 14*b* to the developer holder 14*a* through a slit 36*a*, and further supplied to the magnetic drum 10. A process cartridge may, for example, be composed of the magnetic drum 10 and the developer supply device 14.

The developer holder 14*a* disposed on the surface is rotated in the direction of the arrow A shown in FIG. 2A by a motor 30 that serves as a driving device. On the other hand, the developer reservoir 14*b* disposed inside is fixed so as not to rotate. The developer reservoir 14*b* is provided, at the wall thereof, with one slit 36*a*, which serves as a supply section, in the direction along which gravitational acceleration acts (i.e., in a downward direction in FIG. 2A and FIG. 2B). The slit 36*a*, as shown in FIG. 2B, is formed along the entire length of the developer reservoir in the axial direction thereof. As described above, the developer reservoir 14*b* is fixed so as not to rotate. The liquid developer 24 that is kept in the developer reservoir 14*b* exudes from the slit 36*a* owing to the gravitational force and is supplied to the developer holder 14*a* that rotates in the direction of the arrow A. The developer holder 14*a* is formed of a foam as a liquid absorbent member. The liquid developer 24 exuding from the slit 36*a* is retained in the foam. The developer reservoir 14*b* is provided inside with agitation blades 15 serving as an agitation member that agitates the liquid developer 24.

The foam that forms the developer holder 14*a* is positioned in such a manner that the foam is compressed when it contacts the magnetic drum 10. The magnetic drum 10 and the developer holder 14*a* are driven to rotate in an opposite direction to each other as shown by arrow A and arrow B, respectively, in FIG. 1. In addition, the developer supply device 14 is disposed in the direction along which gravitational acceleration acts with respect to the magnetic drum 10 (i.e. in a downward direction in FIG. 1). The liquid developer 24 retained in the foam of the developer holder 14*a* is conveyed to the compression area N in which the foam is compressed by the magnetic drum 10, whereby the liquid developer 24 exudes from the foam and is supplied to the magnetic latent image 22. As a result, the magnetic latent image 22 is visualized as a toner image 26. At a position where the foam is freed from the compression, the solvent contained in the liquid developer 24 and the toner attached to non-imaging portions are recovered by the foam.

Further, a shield member 34 which blocks off scattering of liquid drops that are splashed from the foam by the rotation of the developer holder 14*a* is provided on the periphery of the developer holder 14*a*.

The developer reservoir 14*b* may be a hollow cylindrical container which is made of a plastics such as polycarbonate or acrylic or a metallic material that is less reactive to a water solvent, such as aluminum, the container having the slit 36*a* in the direction along which gravitational acceleration acts as described above. Note that, the developer reservoir has one slit in the first exemplary embodiment, but may have plural slits. The developer reservoir may have, instead of the slit(s), plural holes as the supply sections in the axial direction of the reservoir.

As the agitation blades 15 provided inside of the developer reservoir 14*b*, agitation blades that are used for conventional agitation members may be used without modification. The motor 38 which drives the developer holder 14*a* may also drive the agitation blades 15. Instead of the agitation blades, an ultrasonic vibrators or the like may be used as the agitation member.

Further, the developer reservoir 14*b* may be connected to a pipe and a mechanism which supplies the liquid developer 24 to the developer reservoir through the pipe and includes a pressure device such as a pump.

Next, the foam that forms the developer holder 14*a* will be described. The foam as used herein is a member which has micropores and may absorb a liquid by capillary action.

Specific examples of the foam include sponge and unwoven cloth.

The water retention rate of the foam used in the first exemplary embodiment is preferably 900% or more and more preferably 950% or more, although this depends on the extent of compression of the foam as described below.

The water retention rate may be measured in accordance with the following method.

First, a foam in a dry state, which is cut into a size of 20 mm×20 mm×20 mm, is prepared, and the weight thereof is measured with an electronic balance or the like. Next, pure water is supplied to the foam in dry state, and the weight of the foam when the absorption saturates is measured. The weight of the foam in a dry state is subtracted from the thus-obtained weight when the absorption saturates, thereby obtaining the weight of the pure water absorbed in the foam. Finally, the water retention rate is calculated by dividing the weight of the pure water absorbed in the foam by the weight of the foam in dry state. These measurements are repeated three times, and an average thereof is regarded as a definitive water retention rate. In addition, the standard deviation of the water retention rate is also calculated and is used as an evaluation item.

The water retention rate described herein is measured in accordance with the above method.

Further, a diameter of the micropore of the foam may be measured in accordance with the following method.

First, a foam is cut with a polishing machine or the like so as to have a planar cross-section with the shape of the micropores being retained. The cross-section is observed with an optical microscope, and diameters of 100 micropores within the observation area are measured. The average of the thus-measured diameters of the micropores is regarded as a diameter of the micropore of the foam. Note that, the diameters of the micropores are measured in such a manner that the maximum lengths of the micropores in one direction, which is determined before the measurement of the diameters of 100 micropores, are measured.

The diameter of the micropore described herein is measured in accordance with the above method.

Further, the hardness of the foam may be measured in accordance with the following method.

The hardness of a foam having a thickness of 100 mm or more may be measured with an Asker C hardness meter. The average of values measured at different three points of the foam is regarded as the hardness of the foam.

The hardness described herein is measured in accordance with the above method.

The extent in which the foam is compressed (extent of compression) at the compression area N (the difference between the outer diameter of the foam in the non-compressed portion and the outer diameter of the foam in the most compressed portion) may vary depending on the water retention rate and the outside diameter of the foam. When the outside diameter of the foam is 25 mm for example, the extent of compression is preferably from 0.1 mm to 10 mm, more preferably from 0.5 mm to 8 mm, and particularly preferably from 1 mm to 5 mm.

Although the first exemplary embodiment is directed to an example in which the developer holder 14*a* is formed of a foam, it should be noted that any liquid absorbent members can be used without limitation as far as the members have liquid absorbing properties. Examples of the liquid absorbent member include cloth members (specifically felt).

Moreover, other than the liquid absorbent member, a member that can retain the liquid developer 24 may be used in the first exemplary embodiment.

Transfer Unit and Fixation Unit

The toner image 26 visualized by the developer supply device 14 is transferred to the sheet 30 by a transfer unit. As described above, in the first exemplary embodiment, the toner image is not directly transferred to the sheet 30 from the magnetic drum 10, but the toner image is first temporarily transferred to the intermediate transfer member 16, and then transferred onto and fixed on the sheet 30. First, the transfer to the intermediate transfer member 16 will be described.

The intermediate transfer member 16 contacts the magnetic drum 10, and the toner image 26 is transferred. Examples of the transfer system generally include an electrostatic transfer system, a pressure transfer system, and an electrostatic pressure transfer system in which the electrostatic transfer system and the pressure transfer system are used in combination. However, as described above, since the toner particles do not have a charge in the first exemplary embodiment, neither the electrostatic transfer system nor the electrostatic pressure transfer system is used. In contrast, according to a usual pressure transfer system, the toner image is adhered and transferred to the surface of the transfer medium while being plastically deformed by the pressure between the magnetic drum 10 and the transfer medium. The pressure transfer system may be used in combination with shearing transfer.

In the first exemplary embodiment, since the toner image 26 is shifted to the intermediate transfer member 16 due to adsorption force, which is stronger than the magnetic force that the magnetic drum 10 exerts on the toner image 26 on the magnetic drum 10 as described above, adhesiveness may be provided to the intermediate transfer member 16 so as to conduct adhesive transfer. For this purpose, for example, a silicone rubber layer having a low hardness may be formed on the surface of the intermediate transfer member 16.

Subsequently, the toner image 26 which has been transferred to the intermediate transfer member 16 is transferred to the sheet 30.

In FIG. 1, a transfer-fixing roller 28 is disposed on the opposite side of the intermediate transfer member 16 to the magnetic drum 10, with the intermediate transfer member 16 located therebetween, in such a manner that the transfer-fixing roller is positioned so as to form a contact area with the intermediate transfer member 16. A sheet 30 is supplied to the contact area between the intermediate transfer member 16 and the transfer-fixing roller 28 in accordance with the timing of the toner image 26 on the intermediate transfer member 16. The transfer-fixing roller 28 may include a stainless-steel substrate, a silicone rubber layer, and a fluoro-rubber layer, for example. The sheet 30 that passes through the contact area is sandwiched under pressure between the intermediate transfer member 16 and the transfer-fixing roller 28, whereby the toner image formed on the intermediate transfer member 16 may be transferred to the sheet 30.

In the first exemplary embodiment, the toner image 26 is transferred from the intermediate transfer member 16 to the sheet 30, and at the same time the toner image 26 is fixed on the sheet 30. Specifically, when the intermediate transfer member 16 is a roller as shown in FIG. 1, it composes a roller pair with the transfer-fixing roller 28. Therefore, the intermediate transfer member 16 and the transfer-fixing roller 28 may serve as a fixing roller and a press roller respectively in a fixation apparatus and provide fixing function. Namely, when the sheet 30 passes through the contact area, the toner image 26 is transferred and at the same time is pressed by the transfer-fixing roller 28 onto the intermediate transfer member 16, whereby the toner particles that form the toner image 26 may be softened and infiltrate into the fibers of the sheet 30.

Under this condition, the toner image may be fixed on the sheet 30 depending on the toner to be used. However, when fixing is not sufficient, the toner image 26 may be heated with the fixing transfer roller or the like so that the toner image 26 is fused, whereby the toner may infiltrate into the fibers of the sheet 30 and the toner image may be fixed as a fixed image 29. After that, the fixed image 29 is hardly peeled off even when the sheet 30 is bent or folded, or an adhesive tape applied thereon and then removed therefrom.

It should be noted that the transfer and fixation to the sheet 30 are performed at the same time in the first exemplary embodiment, but the transfer and fixation may be separately performed, and for example, the fixation may be performed after the transfer. In this case, a transfer roller to which a toner image is transferred from the magnetic drum 10 may have a function similar to that of the intermediate transfer member 16.

Cleaner

When the transfer efficiency of a toner image from the magnetic drum 10 to the intermediate transfer member 16 does not reach 100%, a part of the toner image 26 may remain on the magnetic drum after the transfer. It is the cleaner 18 that serves to remove the remaining toner. The cleaner 18 includes a cleaning blade made of rubber or the like and a container in which the removed remaining magnetic toners are recovered.

It should be noted that, when the transfer efficiency is close to 100% and the remaining toners do not cause any problem, the cleaner 18 may not be provided.

Demagnetization Device

When a new image is formed again, the magnetic latent image is required to be erased by a demagnetization device before a new magnetic latent image is formed by the magnetic head 12. The demagnetization device 20 may be classified into two: a permanent magnet system and an electromagnet system. In a demagnetization device of the permanent magnet system, the magnetic drum 10 is magnetized in the circumferential direction thereof so as not to leak magnetic flux locally. The demagnetization device of the permanent magnet system requires no energy such as electric power and is cost-effective. However, when the magnetic latent image is not to be erased, the demagnetization device 20 is required to be moved from the magnetic drum 10 so as to increase the magnetic distance and to reduce the demagnetization field. In contrast, a demagnetization device of the electromagnet system includes a yoke and a coil, and an electric current flowing is required to flow. When a magnetic latent image is not to be erased, the demagnetization field may be made to be zero by switching off the current, whereby the control thereof is relatively easy.

In the first exemplary embodiment, either of the permanent magnet system and the electromagnet system may be used.

Image Forming Apparatus According to Second Exemplary Embodiment

Next, an image forming apparatus according to a second exemplary embodiment of the invention will be described. The configurations of the image forming apparatus according to the second exemplary embodiment may be the same as those of the first exemplary embodiment, except that the configuration of "the developer reservoir 14*b* provided inside of the developer supply device 14" is different from that of the first exemplary embodiment. Therefore, only the developer reservoir that has a different configuration will be described in the following, and the other explanations will be omitted.

Developer Supply Device

Figure 3A:
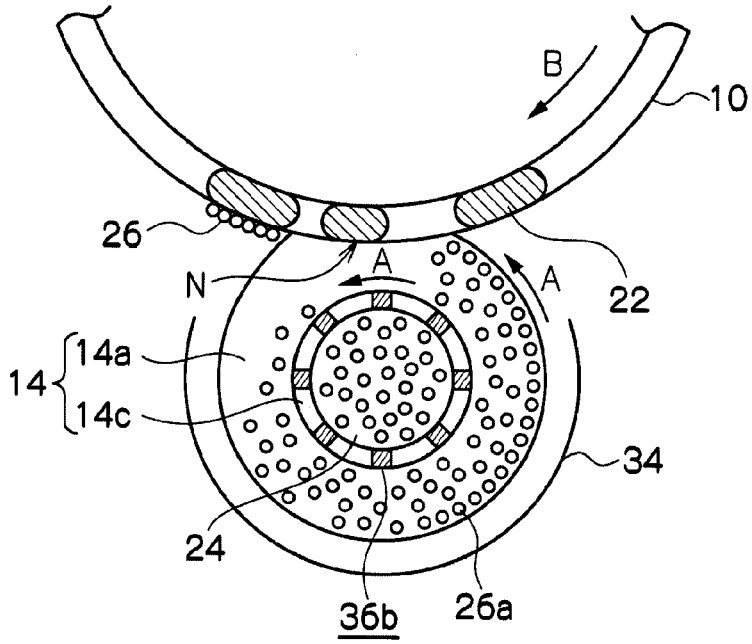
FIG. 3A is an enlarged schematic diagram of a development area of an example of an image forming apparatus according to a second exemplary embodiment of the invention.
Figure 3B:
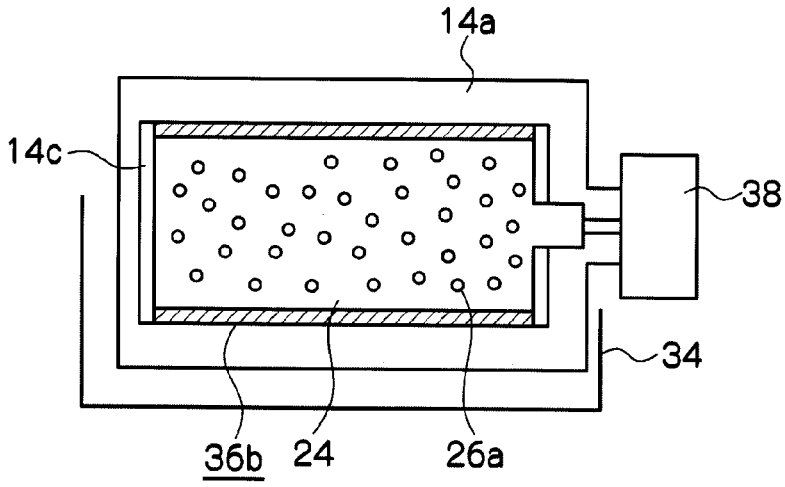
FIG. 3B is a side cross-sectional view of a developer supply device shown in FIG. 3A.

FIG. 3A shows an enlarged schematic diagram of a development area according to the second exemplary embodiment, and FIG. 3B shows the side cross-sectional view of FIG. 3A.

As shown in FIG. 3A, the developer supply device 14 in the second exemplary embodiment includes a developer reservoir 14*c* inside thereof and a developer holder 14*a* on the surface thereof. In this device, a liquid developer 24 is supplied to the developer holder 14*a* from the developer reservoir 14*c* through slits 36*b*, and further supplied to a magnetic drum 10. For example, a process cartridge may be composed of the magnetic drum 10 and the developer supply device 14.

The developer holder 14*a* provided on the surface and the developer reservoir 14*c* provided inside are rotated in the direction of an arrow A shown in FIG. 3A, by a motor serving as a driving device shown in FIG. 3B. The developer reservoir 14*c* has plural slits 36*b* equally spaced in the circumferential direction thereof (in FIG. 3A and FIG. 3B, the slits 36 are shown by the hatched parts in the developer reservoir 14*c*). As shown in FIG. 3B, each of the slits 36*b* is formed over the entire range along the axial direction of the developer reservoir 14*c*. Since the developer reservoir 14*c* rotates as described above, the liquid developer 24 kept in the developer reservoir 14*c* may exude therefrom through the slits 36*b* owing to the centrifugal force and be supplied to the developer holder 14*a* that forms the surface of the developer supply device 14. The developer holder 14*a* may be formed of a foam which may be a liquid absorbent member, and the liquid developer 24 which has bled out through the slits 36*b* may be retained in the foam. Since the developer reservoir 14*c* rotates in the direction of the arrow A, it also serves as an agitation member which agitates the liquid developer 24.

In the second exemplary embodiment, the developer reservoir 14*c* adopts the same embodiment as that of the developer reservoir 14*b* in the first exemplary embodiment, except that the developer reservoir 14*c* has a mechanism for rotation driving (that is, a mechanism connected to the motor 38), has the plural slits 36*b* thereon, and has no agitation blade. Of course, in stead of the slits, for example, plural holes may be formed as supply sections along the axial direction.

Moreover, the developer reservoir 14*c* may be connected to a pipe and a mechanism which supplies the liquid developer 24 to the developer reservoir through the pipe and includes a pressure device such as a pump.

In the first exemplary embodiment and the second exemplary embodiment, a developer supply device has a hollow cylindrical container as a developer reservoir and has a slit or plural slits as a supply section or supply sections. However, the developer supply device is not limited to these, and it is understood that another embodiment may be adopted, for example, in which the developer reservoir also serves as a supply section by forming it from a water-permeable porous material, whereby the liquid developer kept in the developer reservoir may exude therefrom and be supplied to the developer holder.

Liquid Developer

Next, the liquid developer 24 that is used in the image forming apparatus 100 according to the first exemplary embodiment or the second exemplary embodiment will be described.

The liquid developer 24 that is used in the first exemplary embodiment and the second exemplary embodiment (hereinafter, the term "exemplary embodiments of the invention" refers to both of the exemplary embodiments) includes an aqueous medium and a magnetic toner 26*a* dispersed in the aqueous medium. The magnetic toner 26*a* may include magnetic polymer particles which includes a polymer compound and a magnetic powder contained in the polymer compound. In the magnetic polymer particles, magnetic powders are dispersed in the polymer.

Polymer Compound

As the polymer compound, a resin that is conventionally used in a magnetic recording apparatus may be used. Examples of the polymer compound include: homo-polymer resins and copolymer resins of styrene and/or the substituted products thereof; copolymer resins of styrene and (meth) acrylate; multi-component copolymer resins of styrene, (meth)acrylate, and the other vinyl monomers; multi-component copolymer resins of styrene and the other vinyl monomers; and polymers which may be obtained by crosslinking any one of each of the resins. Specific examples of the polymer compound include polymethyl methacrylate, polybutyl methacrylate, polyvinyl acetate resins, polyester resins, epoxy resins, polyamide resins, polyolefin resins, silicone resins, polybutyral resins, polyvinyl alcohol resins, polyacrylic resins, phenol resins, aliphatic hydrocarbon resins, alicyclic hydrocarbon resins, petroleum resins, styrene-vinyl acetate copolymer resins, ethylene-vinyl acetate copolymer resins, wax resins, and their mixtures.

As described above, the magnetic polymer particles that serve as the magnetic toner 26*a* are dispersed in an aqueous medium. However, it is rather difficult to uniformly disperse the magnetic polymer particles in the aqueous medium, in some cases, when polymer particles having conventional compositions, because the polymer compound is hydrophobic and the magnetic polymer particles have surface properties different from those of conventional polymer particles.

In this regard, in the exemplary embodiments of the invention, when a polymer compound is obtained from selected monomer species with controlled composition as described below, the resultant magnetic polymer particles may attain an adequate dispersibility in an aqueous medium and an excellent developing property is obtained when used to develop a magnetic latent image on the magnetic latent image holder.

Hereinafter, the composition of a polymer compound which may be used in the exemplary embodiments of the invention will be described.

The polymer compound as used herein may be a copolymer of ethylenically unsaturated monomers, the ethylenically unsaturated monomers including both a monomer having a hydroxyl group and a hydrophobic monomer. The amount of the hydroxyl group in the polymer compound may be from 0.1 mmol/g to 5.0 mmol/g.

The liquid developer 24 used in the exemplary embodiments of the invention includes magnetic toner particles (or magnetic polymer particles) that are dispersed in an aqueous medium. Therefore, in order that the magnetic toner particles may have an adequate dispersibility in an aqueous medium while the magnetic force thereof may be kept at a certain level or higher, the magnetic toner particles may have a hydroxyl group on the surface thereof. For this purpose, it is preferable that a component of the polymer compound (copolymer) that forms the particles have a hydroxyl group.

The copolymer of ethylenically unsaturated monomers, which may be used as the polymer compound in the exemplary embodiments of the invention, may have hydroxyl groups in an amount within a range that is optimized by copolymerization ratio of the hydrophilic monomer having a hydroxyl group to the hydrophobic monomer, from the viewpoints of dispersibility and stability of the polymer particles in the aqueous medium, and the amount of the magnetic powder contained in a certain amount in the polymer particles.

The amount of the hydroxyl group may vary depending on the amount of the magnetic powder. Therefore, the amount of the hydroxyl group may be defined as the amount of hydroxyl group that is contained in the polymer moiety other than the magnetic powder. The amount of the hydroxyl group is preferably from 0.1 mmol/g to 5.0 mmol/g, more preferably from 0.2 mmol/g to 4.0 mmol/g, and still more preferably from 0.3 mmol/g to 3.0 mmol/g.

The amount of the hydroxyl group may be determined by conventional titration methods. For example, a predetermined amount of an agent such as a pyridine solution of acetic anhydride is added to the polymer; the resultant mixture is heated; water is added to the mixture for hydrolysis; the mixture is separated into particles and a supernatant with a centrifugal machine; and the supernatant is titrated with an ethanol solution of potassium hydroxide or the like using an indicator such as phenolphthalein, to thereby obtain the amount of the hydroxyl group.

The ethylenically unsaturated monomers as used herein are monomers having an ethylenically unsaturated group such as a vinyl group. The following hydrophilic monomers and hydrophobic monomers are included within the scope of the ethylenically unsaturated monomers in the exemplary embodiments of the invention.

Examples of the hydrophilic monomers having a hydroxyl group include 2-hydroxyethyl (meth)acrylate, 2-hydroxypropyl (meth)acrylate, 3-hydroxypropyl (meth)acrylate, glycerin di(meth)acrylate, 1,6-bis(3-acryloxy-2-hydroxypropyl)-hexyl ether, pentaerythritol tri (meth)acrylate, isocyanuric acid tris-(2-hydroxyethyl) ester (meth)acrylate, and polyethylene glycol (meth)acrylate.

Note that, the term "(meth)acrylate" as used herein refers to either "acrylate" or "methacrylate" or both.

Among these, at least one selected from 2-hydroxyethyl (meth)acrylate and polyethylene glycol (meth)acrylate is desirably used.

Moreover, the magnetic polymer particle in the exemplary embodiments of the invention may contain a polymer which may further have a carboxyl group in addition to the hydroxyl group. In this case, a monomer having a carboxyl group may be additionally used as an ethylenically unsaturated monomer to be used in the invention.

Examples of the monomer having a carboxyl group, which may be used in the exemplary embodiments of the invention, include acrylic acid, methacrylic acid, methacryloyloxy ethyl monophthalate, methacryloyloxy ethyl monohexahydrophthalate, methacryloyloxy ethyl monomaleate, and methacryloyloxy ethyl monosuccinate.

Among these, methacryloyloxy ethyl monophthalate is desirably used.

Examples of the hydrophobic ethylenically unsaturated monomer include: an aromatic vinyl monomer such as styrene or α-methyl styrene; an alkyl (meth)acrylate having an alkyl or aralkyl group having 1 to 18 (more preferably 2 to 16) carbon atoms, such as methyl (meth)acrylate, ethyl (meth)acrylate, propyl (meth)acrylate, butyl (meth)acrylate, cyclohexyl (meth)acrylate, 2-ethylhexyl (meth)acrylate, lauryl (meth)acrylate, or benzyl (meth)acrylate; an alkoxyalkyl (meth)acrylate having an alkylene group having 1 to 12 (more preferably 2 to 10) carbon atoms, such as methoxymethyl (meth)acrylate, methoxyethyl (meth)acrylate, ethoxymethyl (meth)acrylate, ethoxyethyl (methacrylate), ethoxybutyl (meth)acrylate, n-butoxymethyl (meth)acrylate, or n-butoxyethyl (meth)acrylate; an amino group-containing (meth)acrylate such as diethylaminoethyl (meth)acrylate or dipropylaminoethyl (meth)acrylate; acrylonitrile; ethylene; vinyl chloride; and vinyl acetate.

Among these, styrene, methyl (meth)acrylate, butyl (meth) acrylate, 2-ethylhexyl (meth)acrylate, lauryl (meth)acrylate, ethoxybutyl (meth)acrylate, benzyl (meth)acrylate, and diethylaminoethyl (meth)acrylate are preferable, and styrene, methyl (meth)acrylate, and butyl (meth)acrylate are particularly preferable.

The amount of the hydrophobic monomer copolymerizable with the hydrophilic monomer is preferably from 1% to 99% by weight, and more preferably from 5% to 95% by weight, with respect to the total monomer components. In particular, when a monomer having a carboxyl group, such as methacryloyloxy ethyl monophthalate, is used, in combination with a monomer having a hydroxyl group, as the ethylenically unsaturated monomer, the amount of the hydrophobic monomer is preferably from 20% to 99% by weight, and more preferably from 50% to 90% by weight, with respect to the total monomer components.

As the other monomers, if necessary a crosslinking agent may be admixed with a reactive mixture (including the ethylenically unsaturated monomers and the like) which is dispersed in an aqueous medium as described later.

As the crosslinking agent to be used, a known crosslinking agent may be selected and used. Examples of the cross linking agent include divinyl benzene, ethylene glycol di(meth)acrylate, diethylene glycol di(meth)acrylate, methylene bis(meth) acryl amide, glycidyl (meth)acrylate, and 2-([1'-methylpropylidene amino]carboxyamino)ethyl methacrylate. Among these, divinyl benzene, ethylene glycol di(meth)acrylate, and diethylene glycol di(meth)acrylate are preferable, and divinyl benzene is particularly preferable.

Further, the polymer compound to be used in the exemplary embodiments of the invention may be mixed with a non-crosslinking resin. The non-crosslinking resin may not be particularly limited as far as it is a polymer which enables fixing particles on a recording medium such as paper or a film in response to: application of an external energy such as heat, UV-light, or electron beam; solvent vapor; solvent vaporization from the polymer; or the like.

Specific examples thereof include homo-polymers or copolymers of: styrenes such as styrene or chlorostyrene; mono-olefins such as ethylene, propylene, butylene, or isoprene; vinylesters such as vinyl acetate, vinyl propionate, or vinyl benzoate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate; vinyl ethers such as vinyl methyl ether, vinyl ethyl ether, or vinyl butyl ether; vinyl ketones such as vinyl methyl ketone, vinyl hexyl ketone, or vinyl isopropenyl ketone; and the like.

Magnetic Powder

Examples of the magnetic powder include magnetite and ferrite, which may be magnetic and represented by the formula of $MO—Fe_2O_3$ or $M—Fe_2O_4$, in which M represents a divalent or monovalent metal ion such as Mn, Fe, Ni, Co, Cu, Mg, Zn, Cd, and Li), and M represents a single metal or plural metals. Specific examples thereof include iron oxides such as magnetite, γ iron oxide, Mn—Zn ferrite, Ni—Zn ferrite, Mn—Mg ferrite, Li ferrite, and Cu—Zn ferrite. Among these, magnetite is more preferably used.

Furthermore, another metal oxide may be used in combination with the magnetic metal oxides, and examples of another metal oxide include non-magnetic metal oxides of a single metal or plural metals of Mg, Al, Si, Ca, Sc, Ti, V, Cr, Mn, Fe, Co, Ni, Cu, Zn, Sr, Y, Zr, Nb, Mo, Cd, Sn, Ba, Pb. Examples of the non-magnetic metal oxides include $Al_2O_3$, $SiO_2$, CaO, $TiO_2$, $V_2O_5$, $CrO_2$, $MnO_2$, $Fe_2O_3$, CoO, NiO, CuO, ZnO, SrO, $Y_2O_3$, and $ZrO_2$.

The average primary particle diameter of the magnetic powders before hydrophobic treatment described later may be in the range of from 0.02 μm to 2.0 μm.

The surface of the magnetic powders may be subjected to a hydrophobic treatment. The method of the hydrophobic treatment is not particularly limited, but the surface of the magnetic powders may be subjected to the coating treatment with a hydrophobizing agent such as various coupling agents, silicone oil, or resins. In particular, the surface may preferably be subjected to the coating treatment with a coupling agent.

The amount of the magnetic powder may be determined owing to a desired magnetic force. In the exemplary embodiments of the invention, the amount is preferably from 2% to 50% by weight, and more preferably from 4% to 30% by weight with respect to the total amount of the components of the magnetic polymer particles.

Other Components

The magnetic polymer particle of the exemplary embodiments of the invention may further include a dye, an organic pigment, carbon black, titanium oxide, or the like, which may be mixed to color the polymer. In this case, the additive may be directly mixed with a mixture of the monomers in which the magnetic powders are dispersed therein. For example, particularly when a pigment such as an organic pigment, carbon black, or titanium oxide is mixed, the pigment may be preliminary mixed with and dispersed in the non-crosslinking resin by a known method using a roll mill, a kneader, an extruder, or the like, and then the resultant mixture may be mixed with the mixture of the polymerizable monomers.

Regarding the method of preparing the magnetic polymer particles that include monomers and the like, for example, the ethylenically unsaturated monomers, a polymerization initiator, and the other components are mixed to obtain a mixed liquid including the monomers and the like. The mixing method is not particularly limited.

Any conventional method may be used for dispersing the magnetic powder in the mixed liquid. Namely, for example, a dispersing machine such as a ball mill, a sand mill, an attritor, or a roll mill may be used. When the monomer components are preliminary separately polymerized and the magnetic powders are dispersed in the resultant polymer, a kneader such as a roll mill, a kneader, a banbury mixer, or an extruder may be used.

In order to obtain the magnetic polymer particles preferably used in the exemplary embodiments of the present invention, any known method may be used. For example, suspension polymerization, emulsion polymerization, dispersion polymerization, seed polymerization or the like is preferably used. Moreover, suspension polymerization may be performed by emulsification method that is known as direct membrane emulsification.

The thus-obtained magnetic polymer particles have a number average diameter of preferably from 0.1 μm to 20 μm, and more preferably from 1.0 μm to 8.0 μm.

When the polymer compound has a carboxyl group, the amount of the carboxyl group is preferably from 0.005 mmol/g to 0.5 mmol/g, more preferably from 0.008 mmol/g to 0.3 mmol/g, and still more preferably from 0.01 mmol/g to 0.1 mmol/g.

The amount of the carboxyl group may be determined by a conventional titration method. For example, an ethanol solution of potassium hydroxide is added to the polymer compound for neutralization; the resultant mixture is separated into particles and a supernatant with a centrifugal machine; and the supernatant that includes an excess amount of potassium hydroxide is titrated with an isopropanol-hydrochloric acid solution or the like using an automatic titrator, thereby obtaining the amount of the carboxyl group.

The liquid developer 24 in the exemplary embodiments of the invention may be a particle dispersion in which the magnetic polymer particles are dispersed in an aqueous medium such as water.

Examples of the aqueous medium include water or a medium that is obtained by adding a water-soluble organic solvent such as methanol or ethanol to water. Among them, water singly is particularly preferable. When the water-soluble solvent is added, the amount thereof may vary depending on the properties of the monomer to be suspended, but is preferably 30% by weight or less, and more preferably 10% by weight or less, with respect to the total amount of the solvent.

In the production of the liquid developer, various auxiliary additives, which may be used in a conventional aqueous dispersion of particles, may be used in combination. Examples of the auxiliary additives include a dispersant, an emulsifier, a surfactant, a stabilizer, a lubricant, a thickener, a foaming agent, a defoaming agent, a coagulant, a gelling agent, a sedimentation inhibitor, a charge controlling agent, an antistatic agent, an aging inhibitor, a softener, a plasticizer, a filler, a colorant, a fragrant substance, an adhesion inhibitor, and a releasing agent.

Examples of the surfactant include: known surfactants such as an anionic surfactant, a nonionic surfactant, and a cationic surfactant; a silicone surfactant such as a polysiloxane oxyethylene adduct; a fluorine-containing surfactant such as a perfluoroalkyl carboxylic acid salt, a perfluoroalkyl sulfonic acid salt, or an oxyethylene perfluoroalkyl ether; and a biosurfactant such as spiculisporic acid, rhamnolipid or lisolecitin.

As the dispersant, any polymer having a hydrophilic structural moiety and a hydrophobic structural moiety may be used. Examples of the polymer include styrene-styrene sulfonic acid copolymers, styrene-maleic acid copolymers, styrene-methacrylic acid copolymers, styrene-acrylic acid copolymers, vinylnaphthalene-maleic acid copolymers, vinylnaphthalene-methacrylic acid copolymers, vinylnaphthalene-acrylic acid copolymers, alkyl acrylate-acrylic acid copolymers, alkyl methacrylate-methacrylic acid copolymers, styrene-alkyl methacrylate-methacrylic acid copolymers, styrene-alkyl acrylate-acrylic acid copolymers, styrene-phenyl methacrylate-methacrylic acid copolymers, and styrene-cyclohexyl methacrylate-methacrylic acid copolymers. These copolymers each may be a random copolymer, a block copolymer, or a graft copolymer.

Moreover, in the exemplary embodiments of the invention, a water-soluble organic solvent may be used in order to regulate vaporization or surface properties. The water-soluble organic solvent may be an organic solvent which is not separated into two phases when it is put into water. Examples thereof include monohydric alcohols, polyhydric alcohols, nitrogen-containing solvents, sulfur-containing solvents, and their derivatives.

Further, in order to control the conductivity and pH of inks, alkali metal compound such as potassium hydroxide, sodium hydroxide, or lithium hydroxide; a nitrogen-containing compound such as ammonium hydroxide, triethanol amine, diethanol amine, ethanol amine, or 2-amino-2-methyl-1-propanol; an alkaline earth metal compound such as calcium hydroxide; an acid such as sulfuric acid, hydrochloric acid, or nitric acid; a salt of a strong acid and a weak alkali such as ammonium sulfate; or the like may be added to the aqueous medium.

In addition, if necessary, for antifungal, antiseptic, or anticorrosion purpose or the like, benzoic acid, dichlorophen, hexachlorophene, sorbic acid, or the like may further be added to the aqueous medium. Still further, an oxidation inhibitor, a viscosity modifier, a conductivity agent, a UV absorber, a chelating agent, or the like may further be added to the aqueous medium.

In the exemplary embodiments of the invention, the average particle diameter of the magnetic polymer particles dispersed in the liquid developer is preferably from 0.1 μm to 20 μm, and more preferably from 1 μm to 8 μm. The average particle diameter of the dispersed magnetic polymer particles is a volume average particle diameter which may be determined with a COULTER COUNTER MULTISIZER 3 (trade name, manufactured by BECKMAN COULTER Corp.).

The production of the liquid developer may be performed in accordance with the following procedure, but is not limited thereto.

First, a dispersion medium which includes water as a main solvent and the respective additives described above is prepared using a magnetic stirrer. Then, the magnetic polymer particles are dispersed in the dispersion medium by a known method and/or using a known apparatus. Specifically, a dispersing apparatus such as a ball mill, a sand mill, an attritor, or a roll mill may be used. Moreover, the particles may be dispersed by a method of dispersing particles by rotating special agitation blades at high speed, such as by a mixer; a method of dispersing particles by the shearing force of a rotor and stator, which is known as a homogenizer; a method of dispersing particles using ultrasonic waves; or the like.

An aliquot of the dispersion liquid is sampled and observed by microscope or the like to confirm that the magnetic polymer particles are independently dispersed from one another in the dispersion liquid. Then, an additive such as an antiseptic agent may be added and dissolution thereof is confirmed. After that, the thus-obtained dispersion liquid is filtered with, for example, a membrane filter having a pore diameter of 100 μm to remove impurity solids and crude particles, thereby obtaining a liquid developer 24 which serves as an image forming recording liquid.

The viscosity of the liquid developer 24 in the exemplary embodiments of the invention may vary depending on an image forming system in which the liquid developer is used, but may be from 1 mPa·s to 500 mPa·s.

EXAMPLES

Test Examples

To confirm the effects of the exemplary embodiments, the following tests are performed. Hereinafter, "part(s)" and "%" represent "part(s) by weight" and "% by weight" respectively, unless otherwise particularly specified.

Test Example 1

Image Forming Apparatus According to First Exemplary Embodiment

Preparation of Magnetic Polymer Particles

To 600 parts of a magnetic powder MTS-010 (trade name, manufactured by TODA KOGYO CORP.), 400 parts of styrene-acrylic resin (S-LEC P-SE-0020 (trade name), manufactured by Sekisui Chemical Co., Ltd.) are added. Then, the mixture is kneaded using a pressure kneader, thereby obtaining a magnetic powder (magnetic powder content: 60%) having a resin-coated surface.

17 parts of hydroxyethyl methacrylate (manufactured by Wako Pure Chemical Industries, Ltd.), 57 parts of a styrene monomer (manufactured by Wako Pure Chemical Industries, Ltd.), and 1 part of divinyl benzene (manufactured by Wako Pure Chemical Industries, Ltd.) are mixed. To the resultant mixture, 40 parts of the surface-coated magnetic powder are added, and then dispersed with a ball mill for 48 hours. To 90 parts of the thus-obtained magnetic powder dispersion liquid, 5 parts of azobisisobutyronitrile (manufactured by Wako Pure Chemical Industries, Ltd.) which serves as a polymerization initiator are added, thereby obtaining a mixture including the monomer and the magnetic powder.

An aqueous solution is prepared in which 28 parts of sodium chloride (manufactured by Wako Pure Chemical Industries, Ltd.) are dissolved in 160 parts of ion-exchanged water. To the aqueous solution, 30 parts of calcium carbonate (trade name: LUMINUS, manufactured by Maruo Calcium Co., Ltd.) and 3.5 parts of carboxymethylcellulose (trade name: CELLOGEN, manufactured by Dai-ichi Kogyo Seiyaku Co., Ltd.) are added as dispersion stabilizers, and are dispersed using a ball mill for 24 hours, thereby obtaining a dispersion medium.

To 200 parts of the dispersion medium, the mixture including the monomer and the magnetic powder is added and emulsified using an emulsifying apparatus (trade name: HIGH-FLEX HOMOGENIZER, manufactured by MST Corp.) at 8,000 rpm for 3 minutes to obtain a suspension liquid. At this time, the number average particle diameter of the suspended particles is 2.5 μm.

On the other hand, nitrogen gas is introduced into a separable flask, which is equipped with a stirrer, a thermometer, a condenser tube, and a nitrogen gas introduction tube, through the nitrogen gas introduction tube to make a nitrogen gas atmosphere in the flask. The suspension liquid is charged in the flask, reacted at 65° C. for 3 hours, further heated 70° C. for 10 hours, and then cooled. The resultant reaction liquid is a dispersion liquid, and no aggregates are observed by visual observation during polymerization.

To the reaction liquid, a 10% hydrochloric acid aqueous solution is added to decompose calcium carbonate, and then the reaction liquid is subjected to solid-liquid separation by centrifugal separation. The obtained particles are washed with 1 liter of ion-exchange water, and further washed by repeating three times 30 minute ultrasonic dispersion in 500 ml of ethanol and centrifugal separation, thereby obtaining magnetic polymer particles.

The magnetic polymer particles are dried in an oven at 60° C., and then passed through a mesh having a mesh size of 5 μm to separate crude particles. After that, the number average particle diameter of the magnetic particles is measured. The number average particle diameter is 2.7 μm.

The amount of the magnetic particles in the magnetic polymer particles, which is calculated from the thermal weight loss measured by thermogravimetric analysis, is 15%.

The amount of hydroxyl group in the magnetic polymer particles is 0.6 mmol/g. The amount of hydroxyl group is measured as follows.

First, the polymer particles are weighed and put in a test tube equipped with a cap. A given amount of a solution, which is prepared in advance by dissolving acetic anhydride (manufactured by Wako Pure Chemical Industries, Ltd.) in pyridine (manufactured by Wako Pure Chemical Industries, Ltd.), is put into the test tube, and the mixture is heated at 95° C. for 24 hours. Then, distilled water is added thereto to hydrolyze the acetic anhydride in the test tube. After that, the mixture in the test tube is subjected to centrifugal separation at 3,000 rpm for 5 minutes to separate it into particles and a supernatant. The polymer is washed with ethanol (manufactured by Wako Pure Chemical Industries, Inc.) by repeating ultrasonic dispersion and centrifugal separation. The supernatant and the liquid obtained after the washing are collected in a conical beaker. The collected liquid is subjected to titration with a 0.1 M potassium hydroxide ethanol solution (manufactured by Wako Pure Chemicals Industries, Inc.) using phenolphthalein (manufactured by Wako Pure Chemicals Industries, Inc.) as an indicator.

A blank test using no polymer is also performed, and from the difference in the amounts of the dripped potassium hydroxide ethanol solution which is used in the titration of the magnetic polymer particles of Example 1 and that of the blank test, the amount of hydroxyl group is calculated in accordance with the following Equation 1.

$$\text{Amount of hydroxyl group}=((B-C)\times 0.1\times f)/(w-(w\times D/100)) \quad \text{Equation 1}$$

In Equation 1, B represents the dripped amount (ml) in the blank test, C represents the dripped amount (ml) in the sample, f represents a factor of the potassium hydroxide solution, w represents the weight (gram(s)) of the particles, and D represents the amount (%) of the magnetic particles in the magnetic polymer particles.

Preparation of Liquid Developer 5 parts of polyvinyl alcohol (PVA) (KURARAY POVAL 217 (registered name, manufactured by Kuraray Co., Ltd.); having a polymerization degree of 1,700 and a saponification degree of 88 mol %) are added to 95 parts of cooled ion-exchanged water, and dispersed by stirring with a magnetic stirrer, and further stirred and dissolved for 3 hours at 70° C. in a water bath, thereby preparing an aqueous PVA solution (PVA: 5%).

| | |
|---|---|
| Magnetic particles: | 5 parts |
| Aqueous PVA solution: | 10 parts |
| Polyoxyethylene (20) cetyl ether (manufactured by Wako Pure Chemical Industries, Ltd.): | 0.5 part |
| Ion-exchanged water: | 84.5 parts |

The components described above are mixed, and dispersed with a ball mill for 3 hours, thereby obtaining a liquid developer which includes the magnetic polymer particles as a magnetic toner. 0.1 ml of the liquid developer is dispersed in 100 ml of a measurement liquid ISOTON (trade name, manufactured by BECKMAN COULTER Corp.). The volume average particle diameter of the particles is measured with a COULTER COUNTER MULTISIZER 3 (trade name, manufactured by BECKMAN COULTER Corp.), and is found to be 3.0 μm.

Image Formation

An image forming apparatus 100 having the configuration shown in FIG. 1 is prepared, and the liquid developer thus obtained is used as a developer.

A magnetic drum 10 is prepared as follows: on an aluminum drum, Ni—P is plated to form an underlying layer having a thickness of 15 μm; Co—Ni—P is plated to form a magnetic recording layer having a thickness of 0.8 μm; and on the magnetic recording layer, a fluorine-containing lubricating plating is performed by using Ni—P-PTFE particles to form a protection layer having a thickness of 1.5 μm. The magnetic recording layer has a coercive force of 400 Oe and a residual magnetic flux density of 7,000 G.

A contact angle at which pure water meets the surface of the magnetic drum 10 is 110° at 25° C. and 50% RH.

A full-line magnetic head having 4 channels, which is made of Mn—Zn ferrite and capable of forming an image as fine as 600 dpi, is used as a magnetic head 12.

As a developer reservoir **14*b* placed inside of a developer supply device 14, a developer reservoir 14*b*, which is made of aluminum, has one slit as shown in FIG. 2**A, and is fixed so as not to rotate, may be used.

A developer holder **14*a*, which can be rotated by the motor 38 and is formed of a foam (trade name: BELL EATER, manufactured by AION Co., Ltd.) is disposed around the periphery of the developer reservoir 14*b***. The foam has a water retention rate of 1,000%, a micropore diameter of 180 μm, a hardness of 2, and a contact angle of 0.1°.

Inside of the developer reservoir **14*b*, blades 15 are provided. The liquid developer is kept in the developer reservoir 14*b*. The developer supply device 14 is placed in such a manner that the foam on the surface thereof is compressed when it contacts the magnetic drum 10** (i.e. in such a manner that a compression area is formed). The extent of compression of the foam is 1 mm.

As the intermediate transfer member 16, an intermediate transfer drum which, is made of aluminum, has a 7.5 mm-thick silicone rubber layer on the surface thereof, and rotates at the same circumferential velocity with the magnetic drum 10, is used. As the transfer and fixing roller 28, an elastic roll, which has a stainless steel core, and a silicone rubber layer and a fluoro rubber layer provided on the outer circumference of the core in this order, is used. The elastic roll is configured in such a manner that the surface thereof is heated at 170° C. by a heating element.

The image forming apparatus 100 having the above configuration is used, and printing conditions are set as follows.

| | |
|---|---|
| Linear velocity of magnetic drum: | 100 mm/sec |
| Circumferential velocity of Developer supply device: | 100 mm/sec, |
| Transfer condition (of intermediate transfer): | The pressure applied to the magnetic drum from the intermediate transfer member is set to be 0.147 MPa (1.5 kgf/cm$^2$) |
| Transfer fixation condition: | The pressure of the transfer-fixing roller against the intermediate transfer member is set to be 0.245 MPa (2.5 kgf/cm$^2$) |

Under these conditions, a striped magnetic latent image (corresponding to half tone) having 30 μm-width stripes is formed on the magnetic drum 10 using the magnetic head 12, and the liquid developer is contacted to the magnetic drum by the developer supply device to develop the latent image.

The water contained in the liquid developer 24 almost does not adhere onto the portion where the toner image 26 is not formed on the drum 10 after development. As a result, no liquid adheres onto the intermediate transfer drum 16 and the sheet 30 after fixation. In the imaging portion, a toner image is developed, whereby a good image is formed.

The amount of the solvent remaining on the magnetic drum 10 after development (or the film thickness of the residual solvent) is measured and evaluated by the following method.

The results are shown in Table 1.

The thickness of a water layer adhering to a portion where the toner image 26 is not formed is measured at three points on the magnetic drum 10, including both ends in the axial direction of the drum 10 and the center thereof, using a laser displacement meter LK-G30 (trade name, manufactured by Keyence Corporation). The average of these values is used as the amount of the residual solvent.

Test Example 2

An image is formed and evaluated in the same manner as in Test Example 1, except that the foam 32 used in Test Example 1 is replaced by another foam which has the water retention rate, micropore diameter, and hardness shown in Table 1.

Note that, the foam used in Test Example 2 is SAQ (trade name, manufactured by Inoac Corporation).

TABLE 1

| | Foam | | | | |
|---|---|---|---|---|---|
| Unit | Water retention rate % | Micropore diameter μm | Hardness — | Extent of compression mm | Evaluation results |
| Test Example 1 | 1,000 | 180 | 2 | 1 | 0.5 μm |
| Test Example 2 | 850 | 700 | 5 | 1 | 2 μm |

Figure 4:
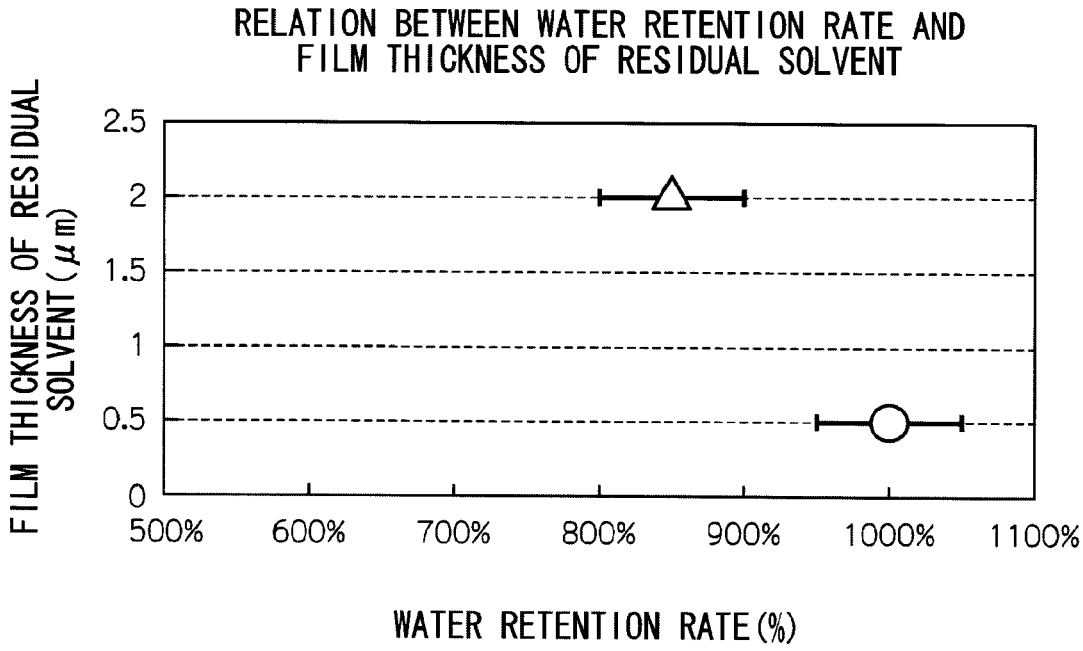
FIG. 4 is a graph showing a relation between the water retention rate and the film thickness of a residual solvent in Test Examples 1 and 2.

FIG. 4 shows the relation between the water retention rate and the thickness of the residual water layer. Note that, the open circle plotted in FIG. 4 denotes the average of the water retention rate in Test Example 1, and the open triangle denotes the average of the water retention rate in Test Example 2. The line extending from each of the open circle and the open triangle indicates the standard deviation.

In Text Example 1 where the amount (i.e. film thickness) of the residual solvent is 0.5 μm, failure in the transfer of the developed image to the intermediate transfer member is effectively suppressed, whereby image degradation is prevented. In Test Example 2, the average of the water retention rate is 850%, and the amount of the residual solvent is 2 μm. However, considering the standard deviation, when the average of the water retention rate is larger than 900%, image degradation is more preferably prevented. Therefore, the water retention rate is preferably larger than 900%, and more preferably 950% or more.

Test Example 3

Image Forming Apparatus According to Second Exemplary Embodiment

A test is performed in the same manner as in Text Example 1, except that the developer supply device 14 is replaced by the following device.

As the developer reservoir 14*b* placed inside of the developer supply device 14, a developer reservoir 14*c*, which is made of aluminum, has plural slits as shown in FIG. 3A, and can be rotated by a motor 38, may be used.

A developer holder 14*a*, which can be rotated by the motor 38 and is formed of a foam (a specific example of the foam is BELL EATER (trade name, manufactured by AION Co., Ltd.)) is disposed around the periphery of the developer reservoir 14*b*. The foam has a water retention rate of 1,000%, a micropore diameter of 180 μm, a hardness of 2, and a contact angle of 0.1 degree.

The liquid developer is kept in the developer reservoir 14*c*. The developer supply device 14 is placed in such a manner that the foam on the surface thereof is compressed when it contacts the magnetic drum 10 (i.e. in such a manner that a compression area is formed). The extent of compression of the foam is 1 mm.

The water contained in the liquid developer 24 almost does not adhere onto the portion where the toner image 26 is not formed on the drum 10 after development. As a result, no liquid adheres onto the intermediate transfer drum 16 and the sheet 30 after fixation.

In the imaging portion, a toner image is developed, whereby a good image is formed.

Note that, the amount of the residual solvent is not measured.

The foregoing description of the exemplary embodiments of the present invention has been provided for the purposes of illustration and description. It is not intended to be exhaustive or to limit the invention to the precise forms disclosed. Obviously, many modifications and variations will be apparent to persons skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A process cartridge, comprising:

a latent image holder which has a water-repellent surface; and a developer supply device which includes a developer holder and a developer reservoir, the developer reservoir being disposed inside of the developer holder, holding a liquid developer, and having at least one supply section that supplies the liquid developer from the developer reservoir to the developer holder, the liquid developer comprising a toner and an aqueous medium, the developer holder comprising a liquid absorbent member, the liquid absorbent member being disposed in such a manner that the liquid absorbent member is compressed when the liquid absorbent member contacts the latent image holder, the latent image holder and the developer holder rotating in mutually opposite directions, and the water-repellency of a surface of the latent image holder surface being higher than the water-repellency of a surface of the developer holder.

2. The process cartridge according to claim 1, comprising at least two supply sections.

3. An image forming apparatus, comprising:

a latent image holder which has a water-repellent surface;

a latent image forming device which forms a latent image on the latent image holder;

a developer supply device which includes a developer holder and a developer reservoir; and a transfer unit which transfers a toner image to a recording medium, the developer reservoir being disposed inside of the developer holder, holding a liquid developer which comprises a toner and an aqueous medium, and having at least one supply section that supplies the liquid developer from the developer reservoir to the developer holder, the developer holder comprising a liquid absorbent member, the liquid absorbent member being disposed in such a manner that the liquid absorbent member is compressed when the liquid absorbent member contacts the latent image holder, the latent image holder and the developer holder rotating in mutually opposite directions, and the water-repellency of a surface of the latent image holder being higher than the water-repellency of a surface of the developer holder.

4. The image forming apparatus according to claim 3, comprising at least two supply sections.

* * * * *